United States Patent [19]

Shoulders

[11] 3,969,039

[45] July 13, 1976

[54] VACUUM PUMP

[75] Inventor: Kenneth R. Shoulders, Woodside, Calif.

[73] Assignee: American Optical Corporation, Southbridge, Mass.

[22] Filed: Aug. 1, 1974

[21] Appl. No.: 494,016

[52] U.S. Cl. ..... 417/244; 415/90; 415/100; 417/405; 250/311

[51] Int. Cl.[2] ..... F04D 19/04

[58] Field of Search ..... 415/90, 99, 100; 417/201, 244, 405; 250/311; 315/108

[56] References Cited

UNITED STATES PATENTS

| | | | |
|---|---|---|---|
| 3,399,827 | 9/1968 | Schwartzman | 415/90 |
| 3,536,418 | 10/1970 | Breaux | 417/201 |
| 3,628,894 | 12/1971 | Ferguson, Jr. | 415/90 |
| 3,644,051 | 2/1972 | Shapiro | 415/90 |
| 3,666,374 | 5/1972 | Becker | 415/90 |
| 3,668,393 | 6/1972 | Rauch | 415/100 |
| 3,696,246 | 10/1972 | Buchanan | 250/311 |
| 3,759,626 | 9/1973 | Becker | 415/90 |

*Primary Examiner*—C. J. Husar
*Attorney, Agent, or Firm*—H. R. Berkenstock, Jr.; William C. Nealon

[57] ABSTRACT

An integral vacuum pump for producing ultra-high vacuums including, in combination, axial turbomolecular, centrifugal compressor and vortex diode pumping means.

4 Claims, 19 Drawing Figures

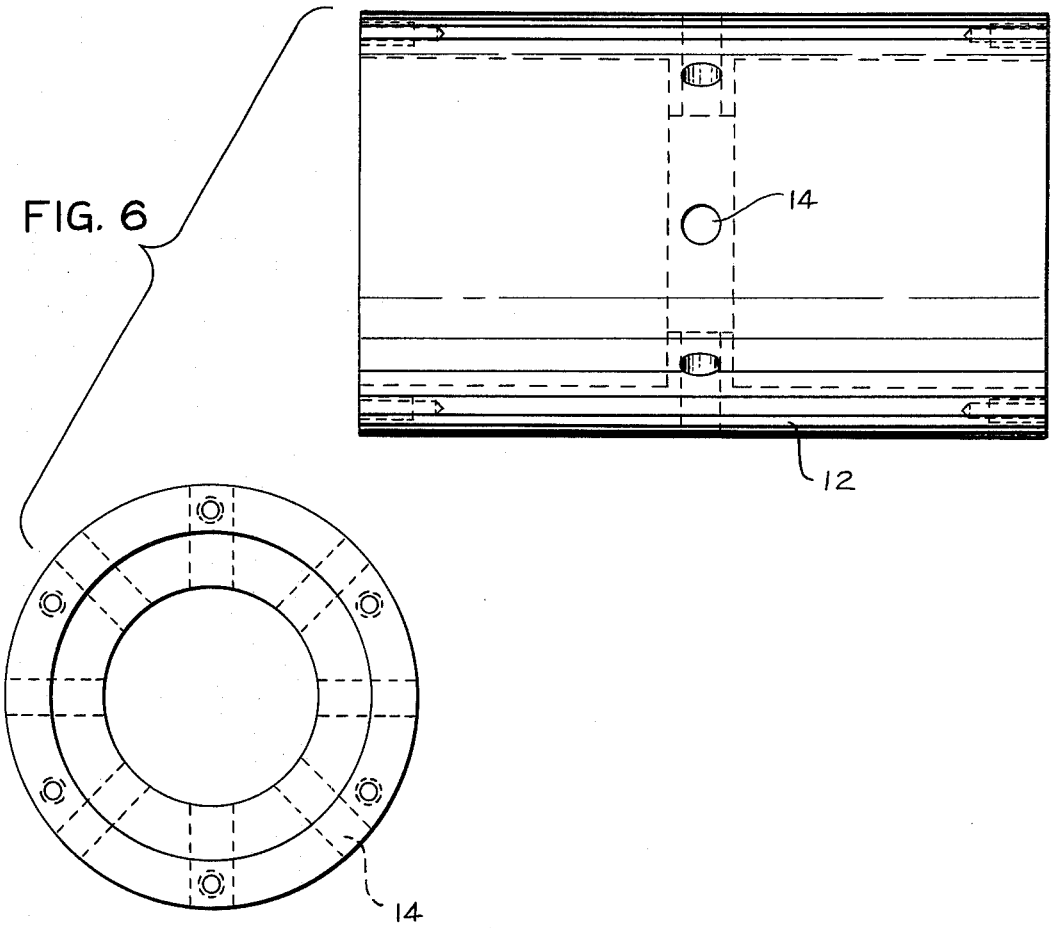
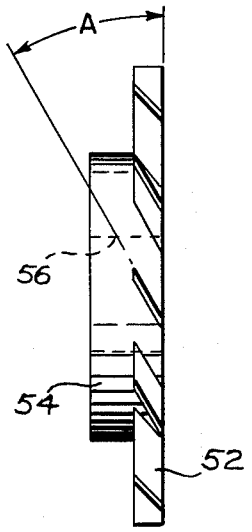
FIG. 2 b
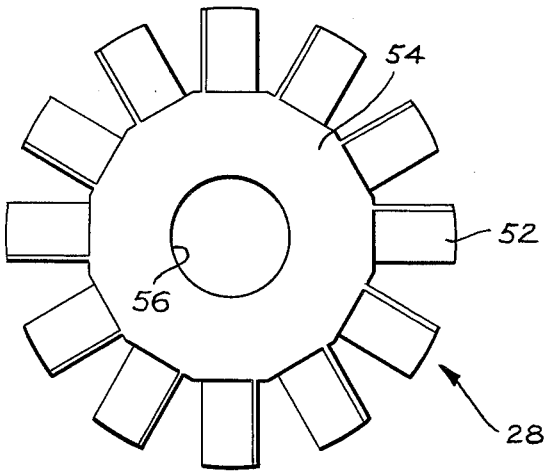
FIG. 2a

VACUUM PUMP

BACKGROUND OF THE INVENTION

This invention relates to a vacuum pump of a type capable of producing high vacuums in closed chambers while avoiding hydrocarbon backstreaming. The disclosed invention incorporates principles of turbomolecular pumps; yet it is a unitary device not requiring a separate forepump.

While turbomolecular pumps are well known to the pumping art, their application has been limited in spite of their ability to produce high vacuum because of a number of considerations. Existing, commercially available turbomolecular pumps generally fall in the category of high capacity pumps having capabilities usually in the range of 150 to 650 liters/sec. of air. As may be appreciated, such units are comparatively large and complex devices and designed for pumping down large vacuum chambers and are adapted to be run over long operating cycles.

The nature of the turbomolecular pump is such that its effectiveness is quite dependent upon the ambient pressure to which it exhausts. Commonly, restrictions of an exhaust forepressure of $10^{-2}$ to $10^{-3}$ Torr are specified for the pump to reach its designed high vacuum capability. It should be immediately recognized that the specified low exhaust pressure thus requires a substantial forepumping by an auxiliary device. It is usual that oil-sealed rotating around pumps having a capacity of 100 to 200 liters are specified as forepumps adequate for turbomolecular installations.

There presently does not exist in the industry a relatively low cost, low volume, high vacuum pumping system adequate for intermittent duty cycling such as in scientific instrument applications. It is with the foregoing in mind that the present pump was invented.

In scientific instruments involving corpuscular beams, it is usual that evacuated chambers wherein these electron or ion beams are generated and directed upon a target, that backstreamed hydrocarbons can cause serious contamination within the chamber. Further, it is usual that the evacuated chamber is well sealed and of limited volume such that high capacity pumps are not required. However, it is also usual that the degree of evacuation required in many such scientific instruments is very high (eg. $10^{-9}$ Torr in the gun region of a field emission electron microscope). Thus, it must be recognized that a vacuum pumping system for such an instrument must be capable of producing high vacuum, while not necessarily being of great quantitative pumping capacity.

Further, in the case of a vacuum system suitable for a scientific instrument, the pump must be capable of reaching full operating characteristics in a relatively short time and over an often repeated duty cycle.

Thus, while the ultra-high vacuum capacity of turbomolecular pumps would seem to offer advantages to such as scientific instrument applications, their vast size and expense, as well as their dependence upon forepumps has led the industry to seek other alternatives, such as ion pumping and similar devices and to turn away from turbomolecular pumping. It was not until the present developments wherein the principles of turbomolecular pumps were combined with the characteristics of other pumping systems that an integral instrument of versatility and operability was provided to the scientific instrument industry.

SUMMARY OF THE INVENTION

In accordance with certain features of the invention there is herein presented a vacuum pumping system suitable for use in evacuating chambers such as exist in scientific instruments, and particularly electron microscopes. The vacuum system of the present invention is adapted to provide low vacuum pressures (in the order of $10^{-6}$ Torr or lower) from a single rotary device including principles of axial flow turbomolecular pumps. Included also in the integral device are a centrifugal compressor pumping means in combination with fluid diode means which together accomplish the objectives sought. Preferred embodiment includes also spiral molecular drag pumping means to further increase the effectiveness of the system.

DESCRIPTION OF THE DRAWINGS

FIG. 2*a* is a front elevation of an axial flow rotary stage included in the invention.

FIG. 2*b* is a sectional view of the rotor of FIG. 2*a*.

FIGS. 6*a* and 6*b* are respectively side and front elevations of the main housing for the pump of the present invention.

DESCRIPTION OF A PREFERRED EMBODIMENT

Figure 1:
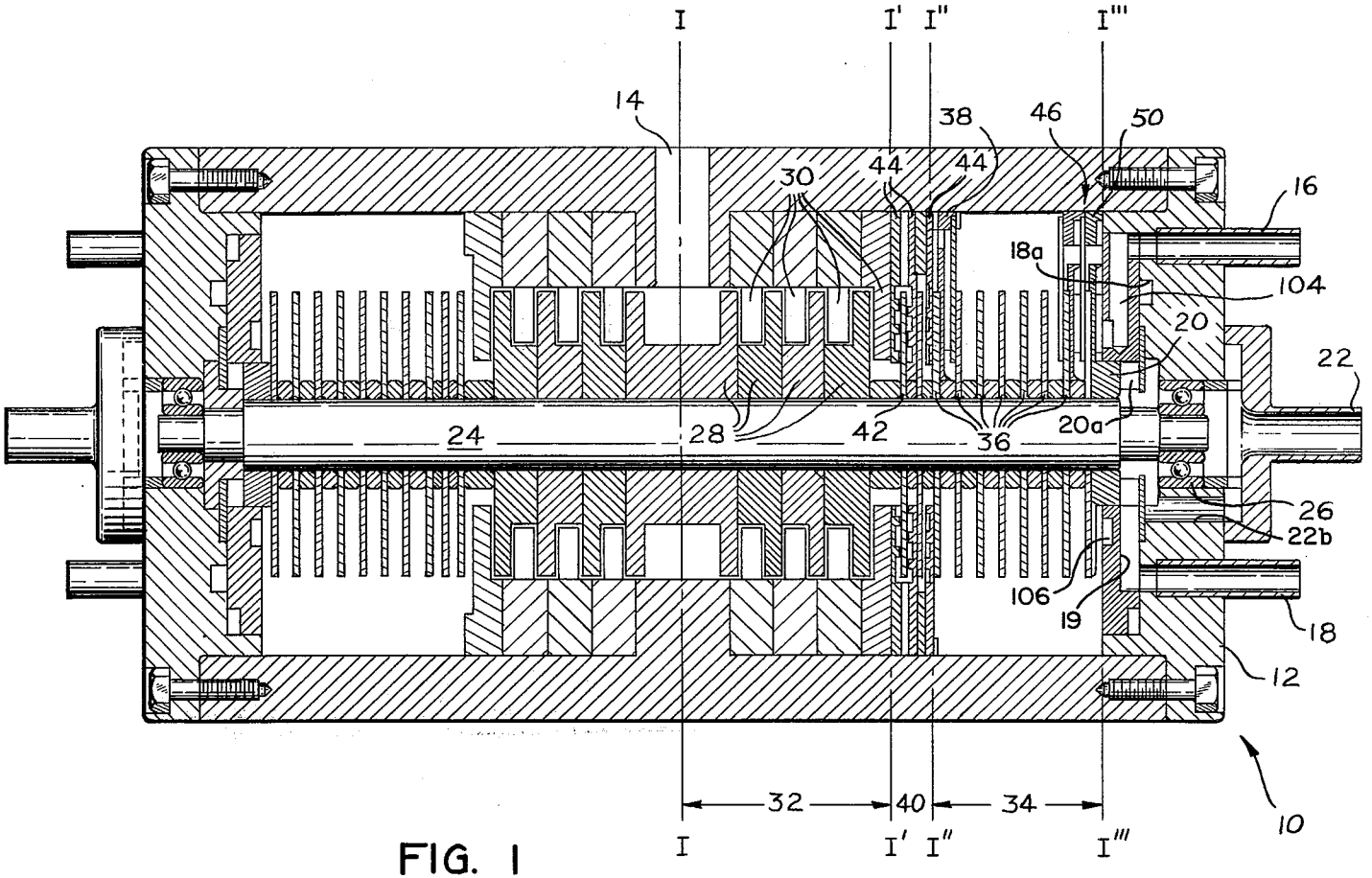
FIG. 1 is a sectional view of the vacuum system according to the invention.

Referring now to the drawings and to FIG. 1 in particular, reference numeral 10 indicates generally the vacuum pump of the present invention. Included are housing 12 being generally cylindrical in shape and enclosing the working section of the pump, later described. Housing 12 includes inlet 14 adapted to be directly connected, in sealed relation, to a chamber to be evacuated (not shown) but understood to be such as the housing of an emission gun of an electron microscope. Disposed (flowwise) at the opposite end of the housing is outlet 16, which in the present invention, exhausts to atmosphere.

Housing 12 also includes an inlet 18 for a drive turbine 20 (later described) and an associated exhaust outlet 22 therefor. Drive turbine 20 in the described embodiment is fixedly secured on shaft 24 which extends axially with housing 12 being disposed in bearing means 26 adapted for rotary motion.

It should be understood that as to the description of the preferred embodiment thus far, as well as that subsequent, pump 10 is symmetric left to right about central axis I—I. The pump section extending from center line I—I to I'—I' includes alternate rotor elements 28 and stator elements 30 (as further illustrated in FIGS. 2*a* through 2*e*), being of the type the coaction of which, produces axial flow turbomolecular pumping. This section indicated by the bracket at 32, and in the preferred embodiment, includes eight sections. These sections are arranged alternately being in the order of rotor section 28 and stator section 30, which additionally are adapted to operate in the range of low pressure of $10^{-6}$ Torr or less. The determination of physical characteristics of the elements for operation at this range may be determined from reference to treatises on the art of molecular drag pumps.

Adjacent the axial flow, turbomolecular stage 32 is an axial flow centrifugal compressor section 34. Centrifugal stage 34 is composed of, alternately, rotor elements 36 (such as the illustrated impeller) and stator elements 38 (such as the illustrated diffuser element). The above elements are further illustrated in FIGS. 4*a* through 4*e*. Centrifugal compressor stage 34 includes eight elements in the illustrated embodiment and is adapted to operate in the pressure range from atmospheric to about $10^{-2}$ Torr thus providing an advantageous operating environment for the turbomolecular stage 32.

In the illustrated embodiment, an additional molecular pumping stage 40 is shown. This stage is of the spiral drag type and is disposed intermediate the axial flow turbomolecular stage 32 and the centrifugal compressor section 34. This spiral drag stage includes alternating rotor elements, as impellers 42 which may be similar to the type illustrated in FIGS. 4*a* and 4*b* and such stator elements as spiral drag plates 44, further illustrated in FIGS. 3*a* and 3*b*. The spiral drag stage is preferably disposed in the pump of the present invention since it provides a further isolation of the very low pressure axial flow turbomolecular stage 32 and the centrifugal compressor 34, thus enhancing the function of the turbomolecular stage 32.

It is a characteristic of such spiral drag pumps that they are capable of molecular pumping to low pressures, yet are less dependent upon a low fore pressure than axial flow turbomolecular pumps to provide effective pumping. Thus it may be seen that a spiral drag stage interposed between an axial flow stage and a centrifugal compressor stage provides an effective low pressure exhaust for axial flow stage 32 during normal operation and effective pumping during start up when centrifugal compressor 34 has not yet reached peak capacity.

The final stage disposed on shaft 24 in the illustrated embodiment is vortex diode stage 46. This stage includes rotary impellers 48 alternately disposed with stator 50 (further illustrated in FIGS. 5*a* through 5*d*). One of the important considerations in the providing of an efficient pump is the minimization of input power or motive force when the apparatus is at normal operating condition. This is a particularly important requirement in pumps which must operate at very high rotary speeds as those which include molecular drag pumping stages. It has been recognized that, at normal operating condition, little work load is imposed on the molecular drag system since the volume of pumping is small with the well sealed chamber at high vacuum. The bulk of the pumping load has been recognized as being borne by the centrifugal section in the recirculation of fluid due to leakage losses and the like. Effectiveness of the present combination of stages is increased by the inclusion of a vortex diode stage which, by virtue of the exhausting flow, markedly increases the impedance for backflow, and thus improves the pressure ratio capabilities of the pumping sections preceding it. It is believed the inclusion of the vortex diode stage 46 also improves the start up performance of the present invention by further enhancing the pressure ratio performance of the centrifugal compressor during the high flow, initial evacuation of the pump housing and chamber to which it is attached.

Figure 7:
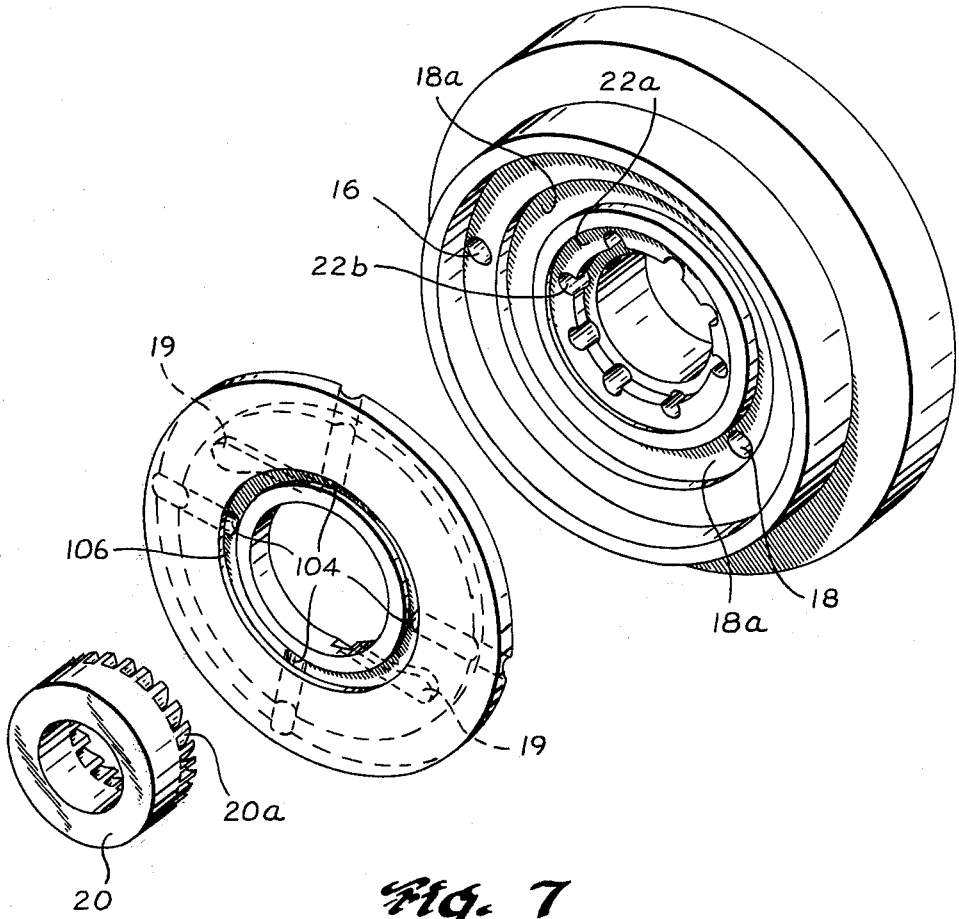
FIG. 7 is an exploded view of the turbine and exhaust members of the invention of FIG. 1.

Disposed on shaft 24 at opposite ends of pump 10 and adjacent exhaust parts 16 and 22 is drive turbine 20, which in the preferred embodiment illustrated provides the motive power for shaft 24 and the plurality of various stage elements. In the application of vacuum pumps in scientific instruments, electrical motors and/or heavy gear drive trains may induce detrimental operational interferences. In the case of electrical motors (a common drive for rotary vacuum pumps), stray fields often cause serious internal interferences in instruments utilizing electron or ion probes. Likewise, the gear coupling utilized to drive rotors as from electro motors may introduce substantial vibrations which further degrade scientific instrument performance. This is particularly true for instruments wherein optical or electro-optical observations are being made. With the foregoing in mind, it has been decided to power the described embodiment by an integral air turbine, fixedly secured to the main shaft 24 of the pump. Low pressure compressed air is commonly available in installations where scientific instruments are used and the inclusion of a rotary, symmetrical drive has been found as an advantageous motive source. In the instant apparatus, compressed air is impressed upon the periphery of the air turbine wheel 22 from a central supply through inlet port 18. The air is dumped into ring 18*a* and from there delivered to nozzles 19 (FIG. 7), and expanded, inwardly toward the shaft 24 and exhausted centrally of shaft 24. Once expanded through the turbine blades 20*a*, the air is collected in exhaust ring 22*a*, exhausted through ports 22*b* to final exhaust port 22.

Referring now to FIGS. 2*a* and 2*b*, the axial flow rotor elements 28 and axial flow stator elements 30 of axial flow turbomolecular stage 32 will be described. FIG. 2*a* shows front and side elevations of a rotor stage 28. Rotor 28 includes blades 52 disposed in equal spacing circumferentially around hub 54. Blades 52 are inclined at an angle A with respect to the axis of rotation depending upon the relative position in element sequence. It is customary in the art that blade angle A be large ( 50°) adjacent the inlet and be progressively decreased toward the pump exhaust (to, typically 10 to 20 degrees). FIG. 2*c* illustrates the typical relative relationship of successive elements 28 and 30. Referring again to element 28 of FIG. 2*a*, hub 54 includes a base 56 to receive rotor 24 and to be fixedly secured thereto. Hub 54 has a thickness coordinated with the lateral extent of blades 52 and stator section 30 to accommodate blades 60 of stator 30.

Figure 2E:
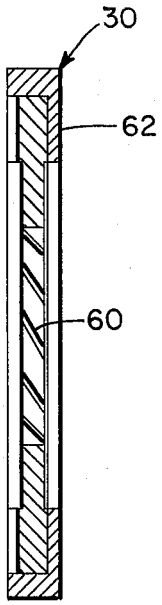
FIG. 2*e* is a sectional view of the stator of FIG. 2*d*.
Figure 2D:
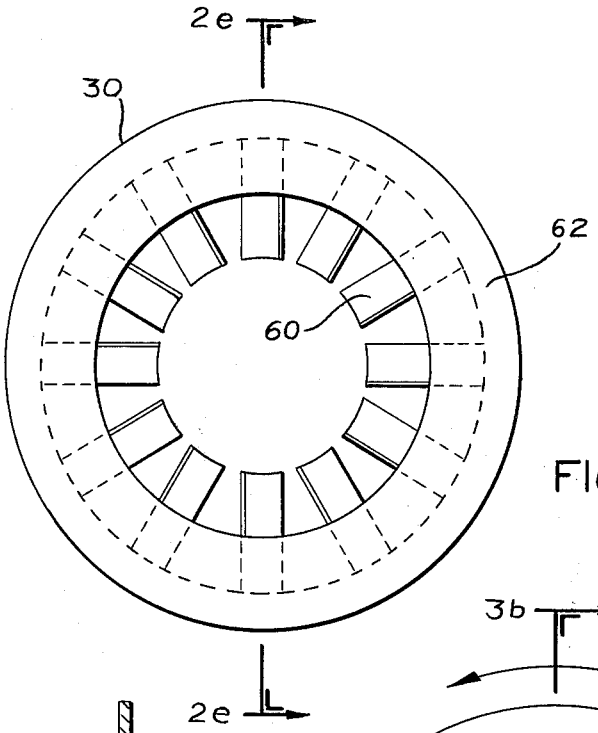
FIG. 2*d* is a front elevational view of a stator of the axial flow turbomolecular pumping stage of the invention.
Figure 2C:
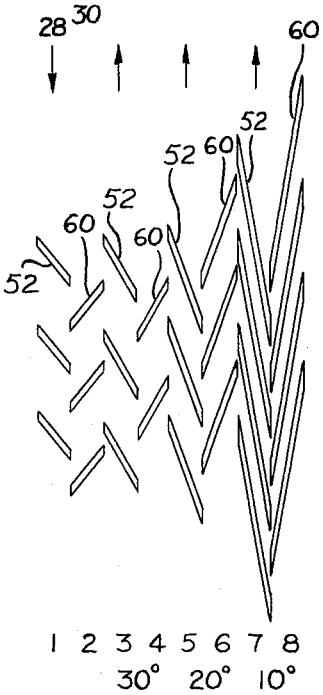
FIG. 2*c* is a plan view showing arrangement of several rotors and stators of the axial flow turbomolecular pumping stage of the invention.

Referring to FIGS. 2*d* and 2*e*, stator 30 has blades 60 disposed in retaining ring 62. Rings 62 are adapted to be fixedly received in housing 12 (FIG. 1) in side-by-side relationship, with blades 60 registered in association with blades 52 and collectively forming the axial flow turbomolecular pumping stage 32.

Figure 3B:
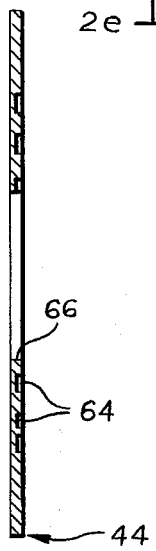
FIG. 3*b* is a sectional view of the stator of FIG. 3*a*.
Figure 3A:
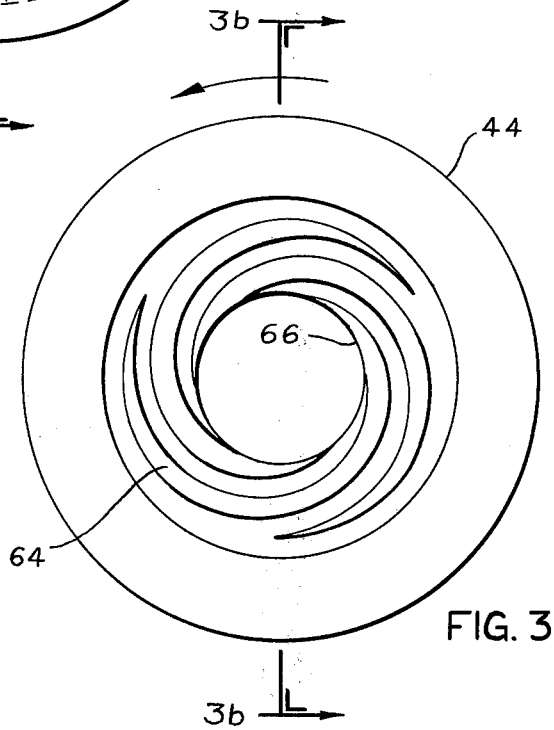
FIG. 3*a* is a front elevational view of a stator of the spiral molecular drag pumping stage of the invention.

Referring now to FIGS. 3*a* and 3*b*, reference number 44 indicates the spiral drag stator for stage 40 immediately following the axial flow stage 32. Stator is adapted with Archimedic spiral grooves 64, which decrease in depth from center base 66 outwardly consistent with known principles. First stator 44' is disposed adjacent the last stator 30 of stage 32, as illustrated in FIG. 1, being operationally associated with a disc impeller 42. A second drag stator 44'' is disposed adjacent stator 42, and adapted with grooves 64 spiralling inwardly, toward the center of the stage. Grooves 64 of second stator 44'' also decrease in depth, but from the periphery toward the center bore 66. This decrease in depth of channel is generally in the direction of fluid flow.

As illustrated at 43 a combination of centrifugal compressor pumping and spiral drag may be employed in conjunction. The impeller 36 at 43 may be of the type illustrated in FIG. 4*a* wherein the rotational element is a disc including radial grooves 68 extending from a collection area 70 outwardly toward the periphery of the element. Vanes 72 are advantageously disposed centrally of the grooves 68 to enhance the centrifugal pumping. Rotor element 36 includes a bore, and is adapted to be fixedly secured to shaft 24. As will be noted in FIG. 4*a*, the back side 74 of rotor 36 is non-grooved, as presents a disc rotor aspect. A spiral drag stator may be disposed adjacent the side 74 of rotor 36 and provide spiral drag pumping centrally toward the center of the pump (toward shaft 24) where the stage is exhausted to a subsequent centrifugal compressor rotor 36.

Figure 4D:
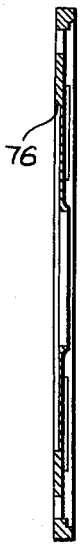
FIG. 4*d* is a partial sectional view of the stator of FIG. 4*c*.
Figure 4C:
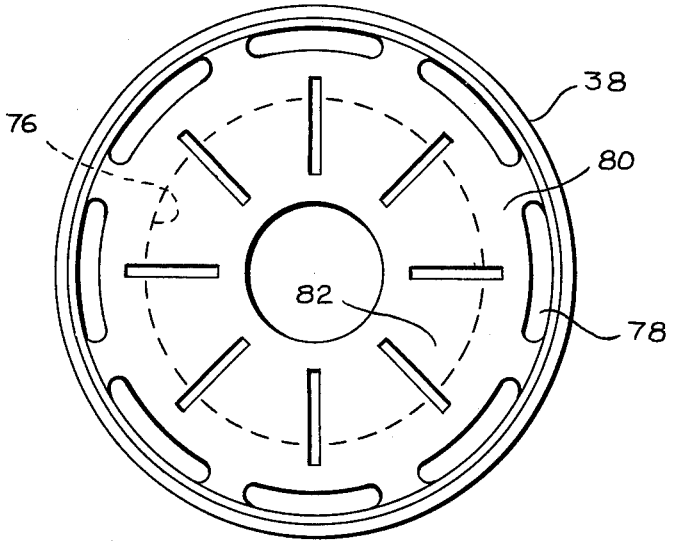
FIG. 4*c* is a front elevational view of a stator of the centrifugal compressor pumping stage of the invention.
Figure 4E:
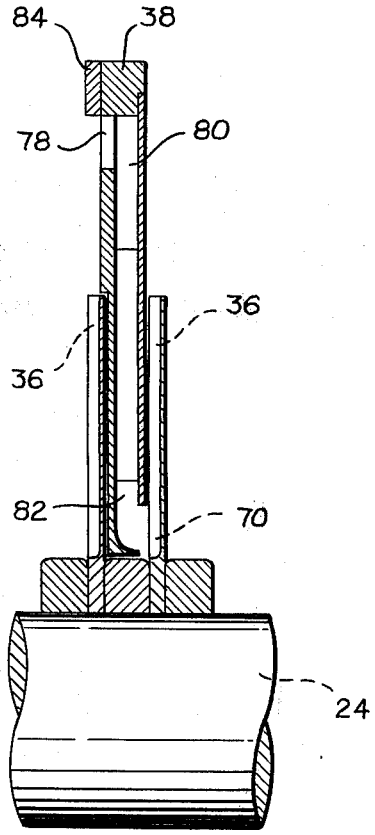
FIG. 4*e* is a partial sectional view of the elements of FIGS. 4*a–d* in assembled relation.
Figure 4B:
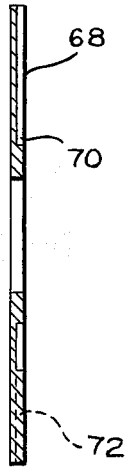
FIG. 4*b* is a sectional view of the rotor of FIG. 4*a*.
Figure 4A:
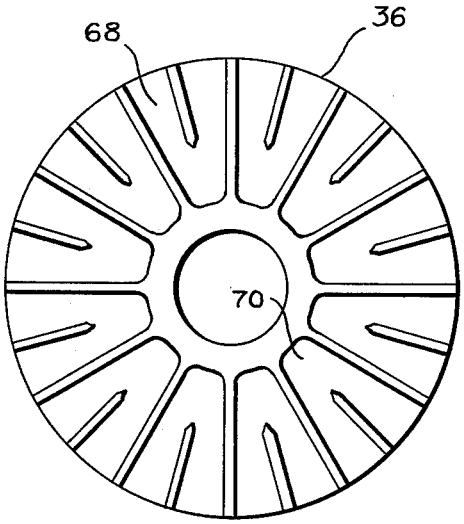
FIG. 4*a* is a front elevational view of a rotor incorporated in several pumping stages of the invention.
Figure 5B:
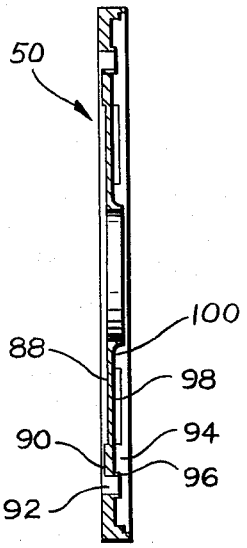
FIG. 5*b* is a front elevation of the stator of FIG. 5*a*.
Figure 5C:
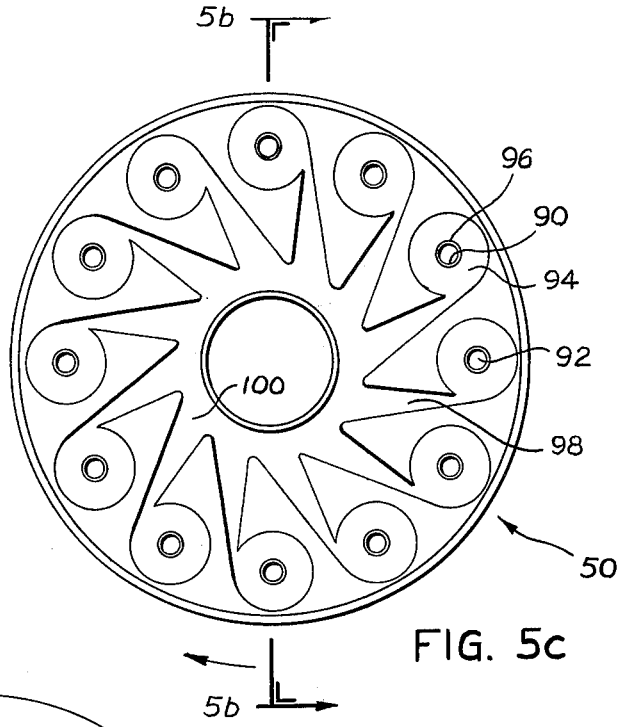
FIG. 5*c* is a partial sectional view of the stator of FIGS. 5*a* and 5*b*.
Figure 5A:
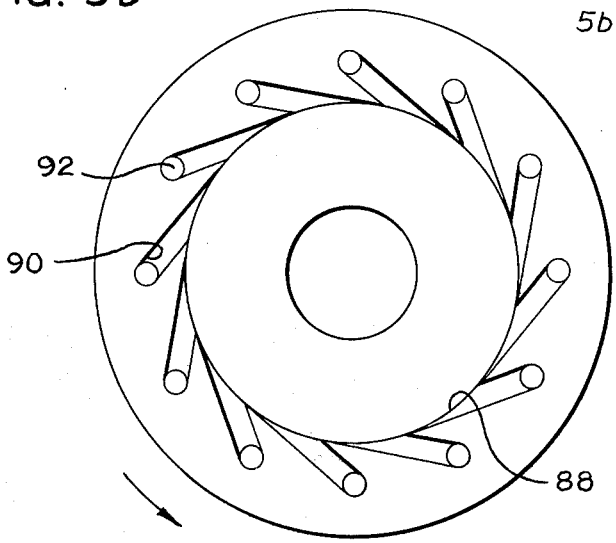
FIG. 5*a* is a rear elevational view of a stator of the vortex diode stage of the invention.
Figure 5D:
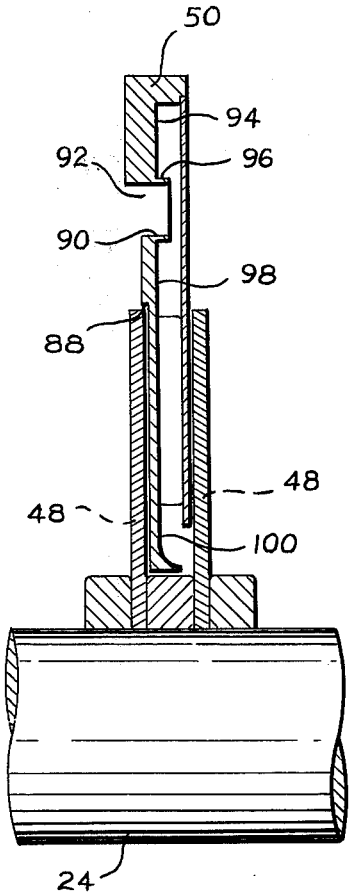
FIG. 5*d* is a partial sectional view of the elements of FIGS. 5*a–c* in assembled relation.

Alternatively, or in combination, centrifugal compressor stage 34 may include diffuser stators 38 interposed between impellers 36. FIGS. 4*c* and 4*d* illustrate a preferred diffuser stator 38 wherein a cylindrical cutout 76 accommodates the disc portion 74 of impeller 36. Disposed circularly adjacent the periphery of stator 36 are a plurality of collector slots 78 communicating with the collector side of stator 38. Collector side 80 includes radially inwardly disposed channels 82 to exhaust the fluid pumped by impeller 36 to the collector area 70 of the subsequent centrifugal impeller. A spacer 84 provides additional spacing between stators 38 to accommodate successive rotors 36. A cover plate 86 provides complete isolation for collector channels 82. FIG. 4*c* illustrates the assembled relationship of rotor 36 and stator 38.

The final operating stage, the vortex diode stage 46, is illustrated in greater detail in FIGS. 5*a* through 5*d*. Diode stator 50 is adapted with a cylindrical relief 88 similar to that of 76 in the centrifugal pumping stage stator. Projecting outwardly from relief 88, in a direction generally tangential thereto, are diffuser grooves 90 which terminate in a collector bore 92 extending through to the exhaust side of stator 50. Bores 92 terminate in a collector basin 94, wherein a walled section 96 of bore 90 extends well into collector basin 94. Extending inwardly toward the center of stator 50 and from basin 94 are channels 98 which terminate in an exhaust pool 100, which discharge to the next subsequent impeller 50. Impellers 48 in the illustrated embodiment are similar to centrifugal impellers 36. Upon exiting the final diode stage stator 50 at exhaust pool 106, channels 104 (FIG. 1) communicate with exhaust part 16, (see also FIG. 7).

Typically, a pump made accordingly to the present invention comprises the axial flow stage, a centrifugal compressor stage and a vortex diode stage. Preferred embodiments may include one or more of the varieties of spiral drag stages heretofore described. The number of stators and rotors may vary accordingly to the load or final pressure to be achieved. Typically, eight axial flow elements are used, seven centrifugal compressor elements, two to four spiral drag elements and two vortex diode stages.

It is to be recognized that angles, dimensions, and numbers of specific elements may be adjusted for particular performance characteristics; however, such variations from the specific illustrations herein are deemed to be within the spirit and scope of the invention subsequently claimed.

What is claimed is:

1. An integral vacuum pump for evacuating a fluid, such as air, from a sealed chamber as in a scientific instrument of the type of an electron microscope comprising:

a housing having an inlet to be connected in sealed relation to said chamber and an exhaust at an opposite end thereof;

a shaft axially disposed in said housing;

motor means for providing rotary motion to said shaft;

axial flow turbomolecular pumping means disposed in said housing, adjacent said inlet, and alternately including stators fixedly secured to said housing and rotors fixedly secured to said shaft, said rotors being in juxtaposed relation to said stators to provide turbomolecular pumping;

centrifugal compressor pumping means disposed in said housing intermediate said axial flow turbomolecular pumping means and said exhaust, including stators fixedly secured to said housing and rotor fixedly secured to said shaft, said rotors being in juxtaposed relation to said stators to provide centrifugal compressor pumping;

fluid diode pumping means disposed in said housing intermediate said centrifugal compressor pumping means and said exhaust including stators fixedly secured to said housing and rotors fixedly secured to said shaft, said rotors being in juxtaposed relation to said stators.

2. A vacuum pump according to claim 1 including spiral molecular drag pumping means disposed intermediate said axial flow molecular drag pumping means and said centrifugal compressor pumping means.

3. A vacuum pump according to claim 1 wherein said motor means is a turbine.

4. A vacuum pump according to claim 1 wherein said fluid diode pumping means is a fluidic vortex diode.

* * * * *